United States Patent [19]

Lindahl et al.

[11] 4,122,686

[45] Oct. 31, 1978

[54] METHOD AND APPARATUS FOR DEFROSTING A REFRIGERATION SYSTEM

[75] Inventors: Herbert S. Lindahl, Danville, Ill.; Chander Datta, Longuenil, Canada

[73] Assignee: Gulf & Western Manufacturing Company, Southfield, Mich.

[21] Appl. No.: 803,121

[22] Filed: Jun. 3, 1977

[51] Int. Cl.[2] ..... F25B 41/00; F25B 47/00

[52] U.S. Cl. ..... 62/81; 62/196 R; 62/278

[58] Field of Search ..... 62/81, 155, 278, 196 R

[56] References Cited

U.S. PATENT DOCUMENTS

| | | | |
|---|---|---|---|
| 2,978,877 | 4/1961 | Long | 62/155 |
| 3,138,007 | 6/1964 | Friedman et al. | 62/278 |
| 3,150,498 | 9/1964 | Blake | 62/81 |
| 3,184,926 | 5/1965 | Blake | 62/155 |
| 3,234,753 | 2/1966 | Quick | 62/196 R |
| 3,343,375 | 9/1967 | Quick | 62/81 |
| 3,427,319 | 2/1969 | Seghetti | 62/196 R |
| 3,464,226 | 9/1969 | Kramer | 62/196 R |
| 3,633,378 | 1/1972 | Toth | 62/196 R |
| 3,638,444 | 2/1972 | Lindahl | 62/81 |
| 3,786,651 | 1/1974 | Eschbaugh et al. | 62/222 |

*Primary Examiner*—Lloyd L. King

*Attorney, Agent, or Firm*—Amster, Rothstein & Engelberg

[57] ABSTRACT

To defrost a selected evaporator, in a system including at least two evaporators, the system condenser is isolated from the compressor and the selected evaporator receives hot, compressed refrigerant vapor directly from the compressor. The liquid refrigerant formed in the defrosting evaporator flows to the other evaporators in the system to permit them to continue in the refrigeration mode. A pressure regulated control system is provided which causes excess liquid refrigerant in the defrosted evaporator to be pumped out of that evaporator before the evaporator is reconnected to the compressor suction line. In a preferred embodiment, each evaporator includes a coil having a plurality of circuits connected between its inlet and outlet and each circuit is disposed in a horizontal plane at a different elevation from any of the other circuits. During the defrost cycle, hot compressed refrigerant vapor flows through either the normal inlet or outlet of the evaporator after passing through a hot gas inlet line which is arranged to pre-heat the lowermost circuits of the evaporator, thereby equalizing the defrosting rate of circuits located at different elevations.

8 Claims, 5 Drawing Figures

FIG. 2
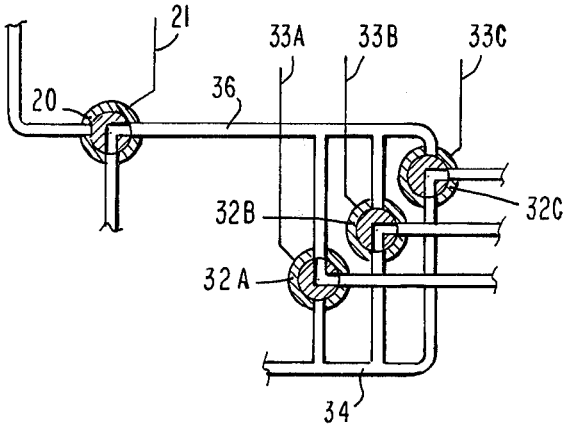
FIG. 3
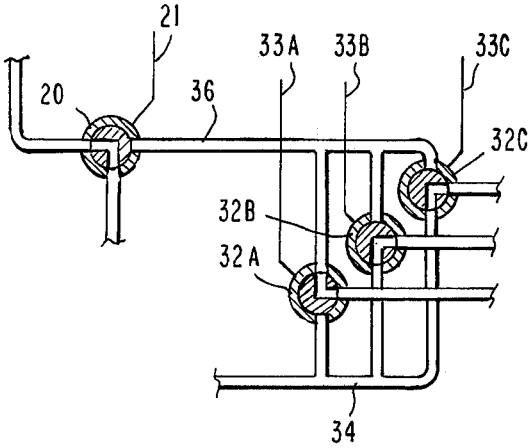
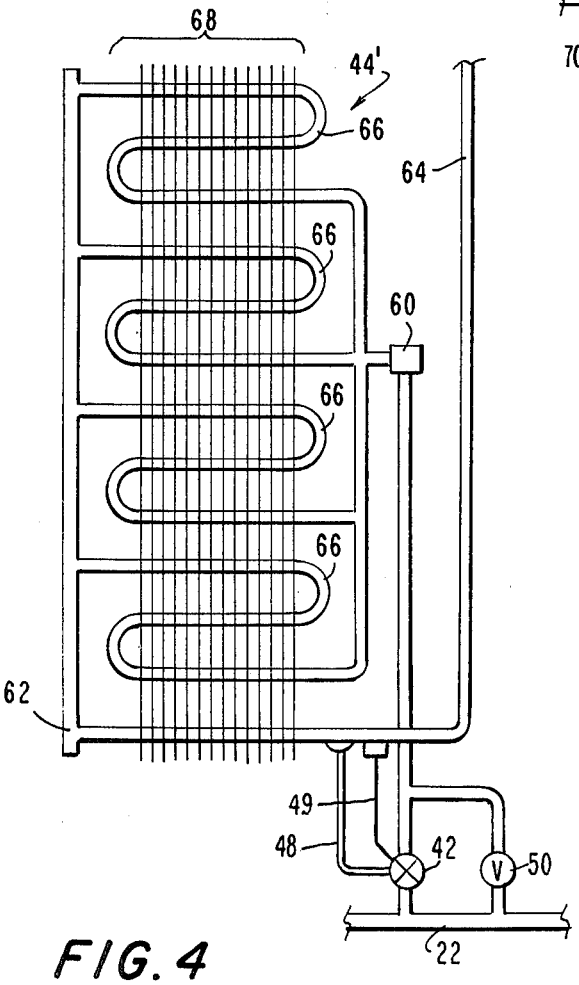
FIG. 4
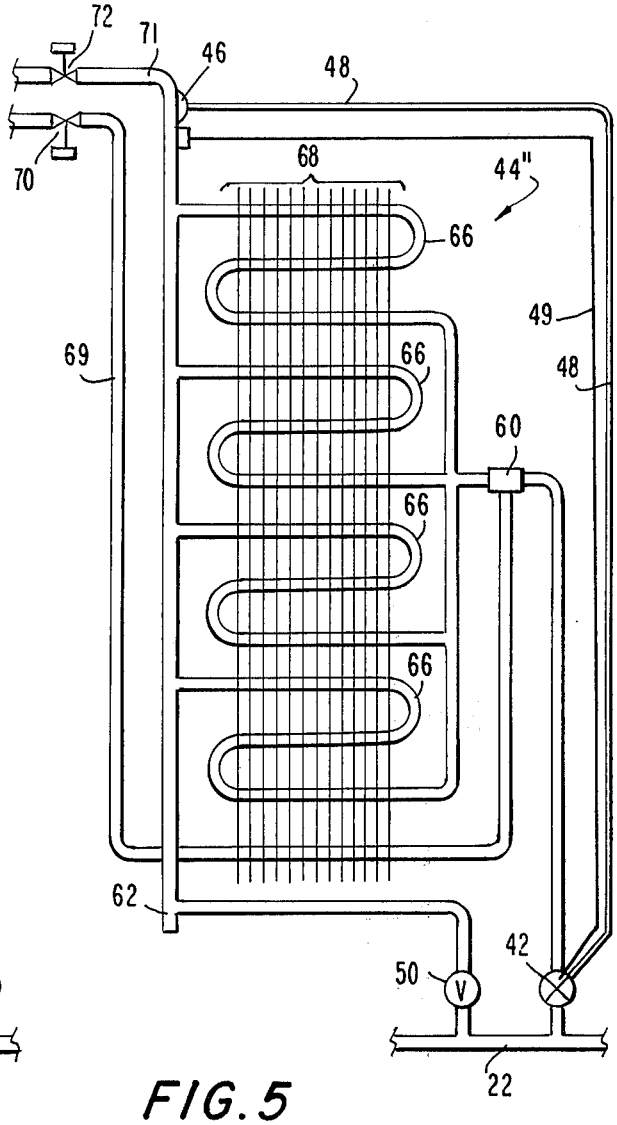
FIG. 5

METHOD AND APPARATUS FOR DEFROSTING A REFRIGERATION SYSTEM

The present invention relates generally to refrigeration systems and, more specifically, involves a method and apparatus for hot gas defrosting of a refrigeration system.

Evaporator coils in modern refrigeration systems typically operate with a surface temperature below the freezing point of water. As a result, moisture from the air condenses on the surface of the evaporator coils, freezes and produces a build-up of frost which prevents proper heat transfer. To maintain efficient operation of a refrigeration system, the evaporator coils are defrosted periodically to remove the build-up of frost.

The aforementioned defrosting must be achieved without interfering with the primary refrigeration function of the system. It is, therefore, a common practice in the refrigeration art to provide a plurality of parallel evaporator units in a system, and each unit is defrosted in turn while the other units continue to provide cooling. It is also known that the hot, compressed refrigerant vapor discharged from the compressor can be provided to an evaporator unit being defrosted to achieve efficient defrosting. See, for example, U.S. Pat. Nos. 3,638,444 and 3,633,378.

In one generally accepted configuration for a self-defrosting refrigeration system, hot, high pressure refrigerant vapors are fed directly to an evaporator which condenses the vapors, thereby defrosting the evaporator coils. The other evaporators in the system continue to act as refrigerating units and receive at least a portion of their liquid refrigerant requirements from the defrosting evaporator.

A major problem with the aforesaid refrigeration systems is that a substantial amount of condensed refrigerant remains in the defrosted evaporator unit upon completion of defrosting. Accordingly, when the defrosted evaporator is re-connected to the compressor inlet, this liquid is drawn into the compressor and can severely damage it. Owing to the relatively large quantity of liquid remaining in the selected evaporator, conventional accumulators employed ahead of the compressor to block the entry of liquid are often ineffective and it becomes necessary to use relatively complex and expensive liquid traps which separate the liquid and meter it back slowly to the compressor as a mist or vapor.

Another problem frequently encountered in existing refrigeration systems relates to the difficulty of achieving efficient refrigeration and defrosting with the same evaporator units. An evaporator unit preferred for its efficiency of cooling includes a cooling coil having a plurality of serpentine circuits, each of which is connected between the inlet and outlet of the coil. The circuits are arranged so that each one lies in a horizontal plane at a different elevation from any of the other circuits. During refrigeration, liquid refrigerant is vaporized simultaneously in each of the parallel circuits to achieve efficient cooling. During defrosting, hot refrigerant vapor is delivered to either the normal inlet or outlet of the evaporator. However, the hot vapor rises and is concentrated primarily in the upper circuits and, accordingly, efficient defrosting is achieved only in the upper circuits. The lower circuits, being starved of hot refrigerant vapor, defrost very slowly, if at all, and slow down the entire defrosting process.

It is an object of this invention to provide an automatically defrostable refrigeration system and a method for operating the system which eliminate one or more of the disadvantages inherent in existing systems. Specifically, it is within the contemplation of this invention to remove substantially all of the excess liquid refrigerant from a defrosted evaporator unit in a refrigeration system prior to restoring the unit to its refrigeration mode of operation. It is also within the contemplation of this invention to improve the efficiency and rate of defrosting in evaporator units of the type described.

It is a further object of this invention to equalize the defrosting rate in an evaporator coil structure of the type described.

It is another object of this invention to achieve the aforementioned objectives in an existing refrigeration system configuration with a minimum number of modifications.

It is also an object of this invention to provide an automatically defrostable refrigeration system achieving the aforementioned objectives which is efficient, reliable and safe in use, yet relatively inexpensive in construction.

In accordance with one aspect of the invention, a selected evaporator unit being defrosted in a refrigeration system of the type described is operated in a pumping mode, immediately after being defrosted and prior to the restoration of the evaporator unit to its refrigeration mode of operation. In the pumping mode, the defrosting evaporator unit is completely isolated from the compressor so that it receives no new hot refrigerant gases. The remaining evaporators, however, continue to remove liquid refrigerant from the defrosting evaporator. This process continues until the pressure inside the defrosting evaporator falls to a predetermined low pressure, at which time the evaporator is restored to its refrigeration mode of operation. The low pressure is selected to correspond to the removal of essentially all excess liquid from the selected evaporator.

In accordance with another aspect of the invention, hot refrigerant vapor from the compressor outlet flows through a hot gas inlet line to either the normal inlet or outlet of an evaporator coil having the described structure. The hot gas inlet line passes under the lowest of the coil circuits. Heat transmitted to the lower circuits aids in defrosting these circuits, thereby substantially improving the efficiency and rate of defrosting.

In accordance with one illustrative embodiment demonstrating objects and features of the present invention, there is provided an improved automatically defrostable refrigeration system having the previously described configuration. In the system, each evaporator unit is connected between a first diverting valve for hot refrigerant vapor from a compressor, and a liquid refrigerant conduit which is provided with a solenoid valve. The first diverting valve can be set to one of two positions: a first position in which the compressor outlet is connected in series with the condenser; and a second position in which the compressor outlet is connected, through second diverting valve means, to one or more evaporators. Each second diverting valve means is associated with each evaporator and can be set to one of two positions: a first position in which the corresponding evaporator unit is connected to the compressor inlet; and a second position in which the corresponding evaporator unit is connected to the compressor outlet. During refrigeration, all three diverting valves are in their first positions and the liquid conduit solenoid is open to permit liquid refrigerant to flow from the condenser to the evaporator units. When a selected evaporator unit is being defrosted, the corresponding diverting valve is moved to the second position and the other diverting valves are kept in their first positions. During the defrosting operation, the liquid conduit solenoid is initially kept open to assure that the non-defrosting evaporators have an adequate supply of liquid refrigerant. However, when the pressure inside the defrosting evaporator reaches a predetermined pressure which corresponds to the accumulation of a substantial quantity of liquid refrigerant in the evaporator, the liquid conduit solenoid is closed. The defrosting operation continues thereafter and the non-defrosting evaporators receive an adequate supply of liquid refrigerant from the defrosting evaporator. The defrosting operation continues until a predetermined pressure, temperature or time corresponding to the removal of substantially all of the frost from the defrosting evaporator. When that predetermined point is reached, the first diverting valve returns to its first position so that hot refrigerant gases from the compressor are fed to the condenser. However, the second diverting valve associated with the defrosting evaporator remains in its second position. Accordingly, the non-defrosting evaporator units continue to draw liquid refrigerant from the defrosted evaporator unit, so that the defrosted evaporator unit is pumped substantially free of liquid. This pumping operation continues until the pressure inside the defrosted evaporator unit reaches a predetermined low point, indicating the removal of excess liquid refrigerant therefrom. When this low pressure point is reached, the defrosted evaporator unit is returned to its refrigeration mode by switching the corresponding second diverting valve to its first position, thereby reconnecting the evaporator outlet to the suction line of the compressor. With the return of the defrosted evaporator to its refrigeration mode of operation, the liquid conduit solenoid is returned to its open position.

The foregoing brief description, as well as further objects, features and advantages of the present invention, will be more completely understood from the following detailed description of presently preferred, but nonetheless illustrative, embodiments of the present invention, with reference being had to the accompanying drawing wherein:

FIG. 2 is a fragmentary schematic diagram showing the diverting valves of the system of FIG. 1 positioned to achieve defrosting of a selected evaporator unit;

FIG. 3 is a fragmentary schematic diagram similar to FIG. 2, and showing the diverting valves positioned to achieve pumping of liquid refrigerant from the defrosted evaporator;

Figure 1:
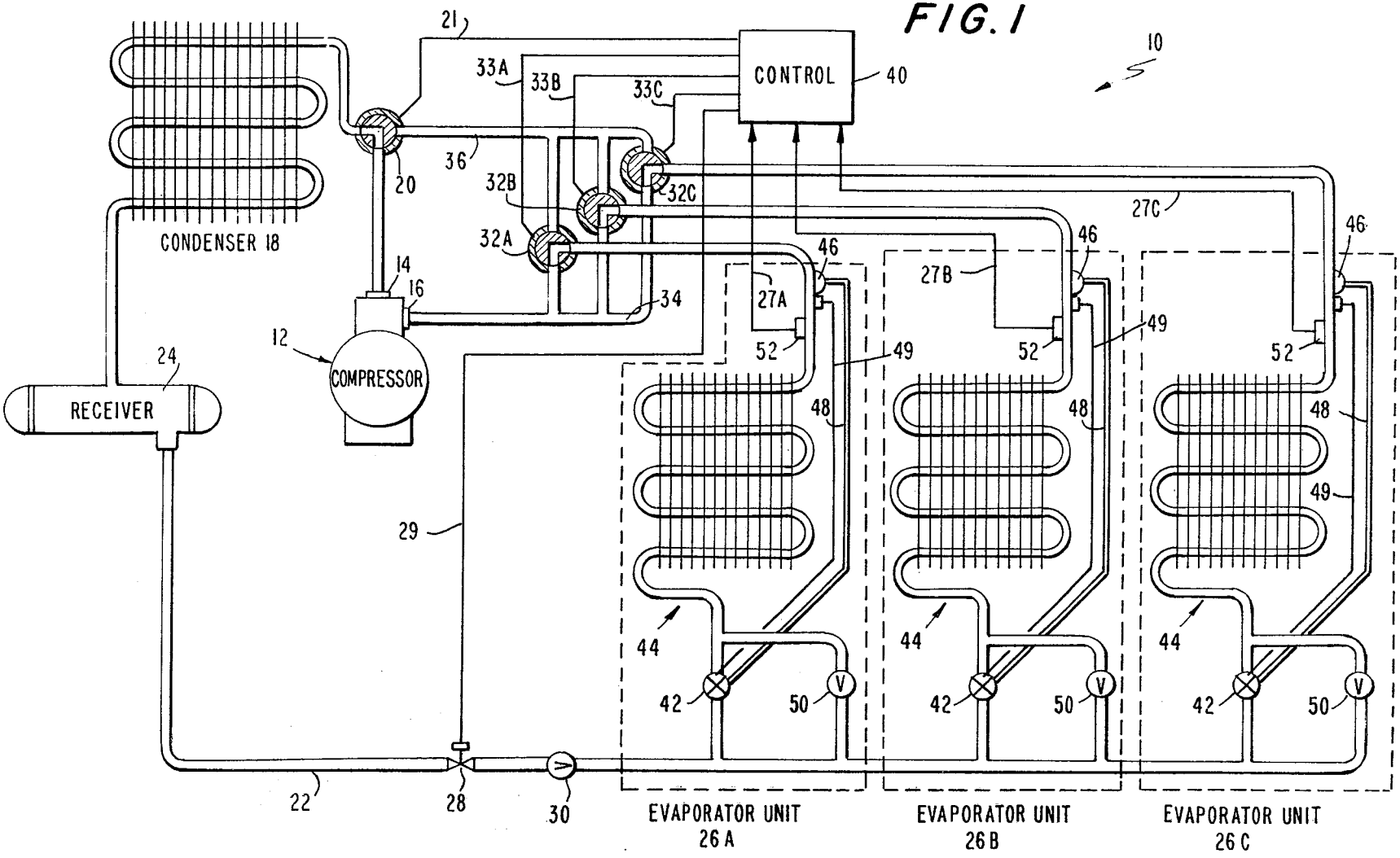
FIG. 1 is a schematic diagram illustrating a refrigeration system embodying the present invention, the system being shown in its refrigeration mode of operation.

FIG. 4 is a schematic diagram illustrating the construction of an improved evaporator coil in accordance with the present invention, the coil being shown in a position to be substituted into the schematic diagram of FIG. 1; and FIG. 5 is a schematic diagram illustrating an alternate construction for an evaporator unit including modifications necessary to incorporate the unit into the schematic diagram of FIG. 1.

Referring now to the details of the drawing and, in particular, to FIG. 1, there is shown an automatically defrostable refrigeration system designated generally by the numeral 10. The system 10 comprises a compressor 12 which compresses low pressure refrigerant vapor received through suction inlet 16 and circulates the refrigerant from its high pressure outlet 14, through the refrigeration system; a condenser 18 which converts the hot refrigerant vapor discharged from compressor outlet 14 to a liquid; and a plurality of evaporator units 26A, 26B, 26C (only three are shown) which are coupled to receive liquid refrigerant from condenser 18, through expansion valves 42, and convert it to vapor by heat transfer with the environment being cooled. During the normal or refrigeration cycle of operation, the refrigerant is continuously re-circulated from the outlet 14 of compressor 12 through condenser 18, expansion valves 42 and evaporator units 26A, 26B, 26C and back to the inlet 16 of compressor 12.

The inlet of condenser 18 is coupled to compressor outlet 14 through an electrically controlled diverting valve 20, and the outlet of condenser 18 is coupled to a liquid conduit 22 through a liquid refrigerant receiver 24. Each of the evaporator units 26A, 26B, 26C has its inlet coupled to liquid conduit 22, and a liquid solenoid valve 28 and a check valve 30 are interposed in conduit 22 between the receiver 24 and the expansion valve 42 preceding each evaporator unit. The outlets of the evaporator units 26A, 26B, 26C are coupled via electrically operated diverting valves 32A, 32B, 32C, respectively, to a suction header 34 and a hot gas header 36. Suction header 34 is coupled to the suction inlet 16 of compressor 12, and hot gas header 36 is coupled to the high pressure outlet 14 of compressor 12 through first diverting valve 20.

Control 40 receives signals indicative of the pressure inside the evaporator units 26A, 26B, 26C via leads 27A, 27B, 27C, respectively, and operates the second diverting valves 32A, 32B, 32C via leads 33A, 33B, 33C, respectively. Control 40 also operates solenoid valve 28 via lead 29 and first diverting valve 20, via line 21, in response to either pressure, temperature or time, to commence and terminate the defrost operation. By varying the position of the different valves, control 40 can place the system in either the refrigeration or defrosting cycle and can operate each of the evaporator units in one of three distinct modes, as will be more fully explained hereinafter.

Each evaporator unit includes a coil 44, which may have any of a number of constructions well-known in the prior art (it is represented schematically in FIG. 1 as a serpentine conduit with a plurality of fins mounted thereon) but which, preferably, is constructed as described in detail hereinafter. The inlet of the coil 44 is coupled to liquid conduit 22 through a balanced expansion valve 42 having an oversized valve orifice and a variable port opening, the size of which is controlled by the temperature and pressure at the outlet of coil 44. Control of the port opening is achieved by coupling pressure and temperature at the outlet of coil 44 back to expansion valve 42, via coupling member 46, tube 48 and temperature sensing line 49. Such an arrangement is described in detail in U.S. Pat. No. 3,786,651 and is hereby incorporated as part of this disclosure. Each evaporator unit also includes a check valve 50, which is connected across expansion valve 42, to permit the flow of liquid from coil 44 to liquid conduit 22. In addition, each evaporator unit includes a conventional electromechanical pressure sensor 52 which senses the pressure at the outlet of the corresponding evaporator coil and produces an electrical signal responsive to this pressure. This pressure signal is coupled to control 40, via one of leads 27A, 27B, 27C.

In the illustrative embodiment, control 40 also includes circuitry (not shown) which is responsive to the electrical pressure signals coupled from the evaporator units via leads 27A, 27B, 27C. The operation of the system is affected when certain predetermined values of these pressure signals are sensed, as is explained hereinafter.

Responsive to a suitable timing device associated with control 40, the system is periodically operated in its defrosting cycle in which each of the evaporator units, in turn, is operated in its defrosting mode, followed by the pumping mode; while the remaining evaporators continue to function in the refrigeration mode.

When all evaporator units are in the refrigeration mode, control 40 positions diverting valves 20, 32A, 32B, 32C, as shown in FIG. 1, and solenoid valve 28 is kept open. Consequently, high pressure outlet 14 of compressor 12 is coupled to the inlet of condenser 18, and the outlets of the evaporator units are coupled to suction header 34. Thus, hot compressed refrigerant vapor, which is discharged from compressor outlet 14, passes through condenser 18 and is liquified; the liquid refrigerant flows through receiver 24 to liquid conduit 22 and passes freely through open solenoid valve 28 and check valve 30, to the inlets of the evaporator units. In each of the evaporator units, the liquid refrigerant passes through an expansion valve 42 and is vaporized in a coil 44 to cause cooling. From the evaporator units, the refrigerant vapor is drawn by compressor suction into suction header 34, and into compressor inlet 16.

Referring now to FIG. 2, control 40, responsive to a time signal, begins the defrosting cycle by rotating first diverting valve 20 counterclockwise by 90°, to isolate condenser 18 and receiver 24 from compressor outlet 14 and to connect hot gas header 36 with compressor outlet 44. The second diverting valve corresponding to the evaporator unit selected for defrosting, for example, valve 32A, is also rotated 90° counterclockwise to the position shown in FIG. 2. The second diverting valves corresponding to the other evaporator units are retained in the refrigeration position.

With the diverting valves positioned as described, hot compressed refrigerant vapor discharged from compressor outlet 14 flows through hot gas header 36, to the outlet of evaporator unit 26A, and circulates through the coil 44 thereof. In the process, the coil 44 is heated so that its surfaces are defrosted and the hot, high pressure refrigerant vapor is condensed. Check valve 50 serves to bypass expansion valve 42 and carry the liquid refrigerant to liquid conduit 22. From liquid conduit 22 the liquid refrigerant flows to the remaining evaporator units, in the manner previously described, and permits these units to continue operating in the refrigeration mode. Check valve 30, in the liquid conduit 22, prevents this liquid refrigerant from flowing back into receiver 24.

Control 40 keeps liquid solenoid valve 28 open until the signal coupled to it, via lead 27A, indicates that the pressure inside the coil of the defrosting evaporator unit 26A has reached a predetermined level. This pressure level is selected to correspond to the accumulation of sufficient liquid refrigerant inside the evaporator unit 26A to provide an adequate supply of liquid refrigerant to the non-defrosting evaporators. In a typical refrigeration system in accordance with the invention employing an R-502 refrigerant, the pressure level will be in the range of 75 to 110. The pressure level may vary, depending upon such factors as the area being refrigerated and the number of evaporators in the system.

When the evaporator unit 26A has been completely defrosted, as determined by predetermined time, temperature or pressure levels, control 40 causes first diverting valve 20 to be rotated clockwise by 90° so that it is in the position shown in FIG. 3. With the first and second diverting valves in the position shown in FIG. 3, evaporator unit 26A is isolated from the compressor so that the supply of high pressure refrigerant vapors from the compressor to the defrosting evaporator unit is terminated. However, the evaporator units 26B and 26C, which are operating in the refrigeration mode, continue to withdraw liquid refrigerant from evaporator 26A, via liquid conduit 22, thereby depleting the supply of liquid refrigerant within evaporator unit 26A and, in effect, pump the liquid refrigerant out of the defrosted evaporator. Control 40 retains the valves in the positions indicated in FIG. 3 until the signal on lead 27A indicates that the pressure inside evaporator unit 26A has dropped to a predetermined pressure, at which time diverting valve 32A is returned to the position indicated in FIG. 1 and solenoid valve 28 is opened. The pressure is selected to correspond to the removal of substantially all excess liquid refrigerant from the coil 44 of evaporator unit 26A, thereby eliminating the danger of damage to compressor 12 which would otherwise be caused by feeding liquid refrigerant to it. In a typical refrigeration system in accordance with the invention employing an R-502 refrigerant, the pressure will be in the range of 90 to 120. The selected pressure may vary, depending upon such factors as evaporator temperature and the temperature in the area being refrigerated.

The foregoing defrosting operation will, of course, be sequentially carried out with respect to each evaporator in the system.

FIG. 4 illustrates one preferred construction 44' for the coil 44 of the evaporator units 26A, 26B, 26C of FIG. 1 and also shows associated elements. The coil 44' has an inlet 60 coupled to liquid conduit 22, via expansion valve 42 and check valve 50, and has an outlet header 62 coupled to one of the diverting valves 32A, 32B, 32C, via outlet line 64, in the manner indicated in FIG. 1. Coil 44' also includes a plurality of serpentine conduits or circuits 66, each of which is connected between its inlet 60 and outlet header 62. Although the circuits 66 are shown schematically as lying in the plane of the drawing at different elevations, in the physical structure they are actually disposed in different horizontal planes, lying at different elevations. Coil 44' also includes a plurality of vertical fins 68, each of which is secured to each of circuits 66 to aid in heat transfer. Line 64, which also serves as an inlet line for hot high pressure refrigerant from header 36 during the defrost cycle, passes under the lowest of circuits 66 and intersects each of fins 68. As a result of this construction, the bottoms of fins 68 are pre-heated during the defrost cycle; and the lower circuits are aided in defrosting via the heat provided by conduction from the bottom of fins 68 and by convection from line 64. This pre-heating of the lower circuits 66 equalizes the defrosting rate of the circuits at different elevations, and defrosting of the evaporator is more quickly and efficiently achieved.

FIG. 5 illustrates an alternate construction 44'' for the evaporator coils 44' shown in FIG. 4, and indicates associated elements. The major difference between the construction of FIG. 5 and that of FIG. 4 is that, in the former, hot refrigerant vapor for defrosting the coil is provided to the coil inlet (during the refrigeration mode); whereas, in the latter, it is coupled to the coil outlet (during the refrigeration mode). In coil 44'', hot refrigerant vapor from the compressor is provided through a separate hot inlet line 69 which is directly connected to hot gas header 36, through a solenoid valve 70. Solenoid valve 70 is opened by control 40 to achieve defrosting of coil 44''. The outlet header 62 of coil 44'' is coupled directly to suction header 34, through outlet line 71 and solenoid valve 72. Solenoid valve 72 is operated by control 40 and opens only when the evaporator is operating in the refrigeration mode. When coil 44'' is operated in either the defrosting mode or the pumping mode, solenoid valve 72 is closed and liquid refrigerant flows from outlet header 62 to liquid conduit 22, through check valve 50. From the foregoing description, it will be appreciated that solenoid valves 70 and 72 in an evaporator unit having the structure of FIG. 5 replace the diverting valves 32A, 32B, 32C of FIG. 1. A pair of solenoid valves could, similarly, be substituted in FIG. 1 for each of the diverting valves.

Although specific embodiments of the invention have been disclosed for illustrative purposes, it will be appreciated by those skilled in the art that many additions, modifications and substitutions are possible without departing from the scope and spirit of the invention, as described in the accompanying claims. For example, in a large system having many evaporator units, groups of evaporator units could be defrosted simultaneously while the remaining evaporator units operate in the refrigeration mode.

What is claimed is:

1. In a method of defrosting a refrigeration system which includes a compressor, condenser and receiver connected in series with each other and in series with a plurality of parallel connected evaporator expansion valve structures and wherein defrosting of an evaporator is accomplished by isolating the condenser and receiver from the compressor; isolating the defrosting evaporator outlet from the compressor inlet; and passing hot, compressed refrigerant gas directly from the compressor to the evaporator being defrosted while continuing the refrigeration cycle in the remaining evaporator expansion valve structures utilizing liquid refrigerant from the condenser, receiver and from the defrosting evaporator, the improvement comprising:

(a) discontinuing the flow of hot, compressed refrigerant gas to the defrosting evaporator at a predetermined, relatively high pressure, temperature or time;

(b) monitoring the pressure in the defrosting evaporator;

(c) maintaining the defrosting evaporator isolated from the compressor inlet line after said flow of hot, compressed gas to the defrosting evaporator is discontinued until a predetermined, lower pressure has been reached; and (d) terminating the defrost cycle by re-establishing the connection between the defrosting evaporator outlet and the compressor inlet.

2. The method of claim 1, wherein said evaporator expansion valve structures are balanced expansion valves having oversized valve orifices.

3. The method of claim 1, wherein the flow of liquid refrigerant from the condenser and receiver to said remaining evaporator expansion valve structures is discontinued in response to a predetermined pressure level indicating the accumulation of sufficient liquid refrigerant in the defrosting evaporator to provide an adequate flow of liquid refrigerant to the non-defrosting evaporators and said flow of liquid refrigerant from said condenser and receiver is re-established to all non-defrosting evaporators upon termination of the defrost cycle.

4. A refrigeration system including hot gas defrosting means comprising a circulating refrigerant, a compressor and a condenser connected in series with each other and in series with a plurality of parallel connected evaporator expansion valve structures, each such structures including an evaporator, an expansion valve and by-pass means for circumventing said expansion valve; first diverting valve means for isolating said condenser from said compressor and diverting the flow of hot refrigerant gas from the compressor to the evaporators; second diverting valve means separately associated with each evaporator expansion valve structure, each said second diverting valve means having a first position which connects the outlet of each said evaporator expansion valve structure with the inlet of the compressor, and a second position which connects the compressor outlet directly with the evaporator; pressure sensing means connected to each evaporator for determining the pressure therein; control means responsive to said pressure sensing means for controlling said first diverting valve means and said second diverting valve means, whereby defrosting of an evaporator is accomplished by moving said first diverting valve means to a position which isolates the condenser from the compressor, moving said second diverting valve means to said second position to permit hot refrigerant gas to flow directly from the compressor to the defrosting evaporator, maintaining the aforesaid positions of said first and second diverting valve means until the defrosting of the evaporator is completed as determined by a pressure, temperature or time signal, thereafter moving said first diverting valve means in response to said predetermined signal to said first position to thereby isolate the defrosting evaporator from the compressor outlet and permit the liquid refrigerant formed in the defrosting evaporator to drain from said defrosting evaporator through said by-pass means and flow directly to the non-defrosting evaporator expansion valve structures and moving said second diverting valve means to its first position in response to the attainment of a predetermined low pressure in the defrosting evaporator.

5. The system of claim 4, further including flow control valve means for controlling the flow of refrigerant in the conduit connecting the condenser, receiver and the evaporator expansion valve structures, said flow control valve means being operatively connected to said pressure responsive control means.

6. The system of claim 5, further including a check valve interposed in said conduit for preventing the flow of liquid refrigerant from said evaporator expansion valve structures to said condenser.

7. The system of claim 4, wherein each of said evaporator expansion valve structures includes an evaporator coil having an inlet and an outlet, said evaporator coil includes a plurality of circuits connected between said coil inlet and said coil outlet, each of said circuits lying substantially in a horizontal plane and at a different elevation than any other of said circuits, a plurality of cooling fins, each of said cooling fins mounted to each of said circuits and a hot gas inlet tube having an inlet adapted to be connected in series with said compressor outlet and an outlet connected to either said coil inlet or said coil outlet, said tube intersecting each of said fins at a point below the lowest of said circuits.

8. The system of claim 7, wherein each of said evaporator expansion valve structures are balanced expansion valves having an oversized valve orifice and a port opening of variable size and including means responsive to the temperature and pressure inside said coil for controlling the size of said port opening.

* * * * *